US008851959B2

(12) United States Patent
Jiang et al.

(10) Patent No.: US 8,851,959 B2
(45) Date of Patent: Oct. 7, 2014

(54) CHEMICAL MECHANICAL POLISHING DEVICE AND POLISHING ELEMENT

(75) Inventors: Li Jiang, Shanghai (CN); Mingqi Li, Shanghai (CN)

(73) Assignee: Semiconductor Manufacturing International (Shanghai) Corporation, Shanghai (CN)

( * ) Notice: Subject to any disclaimer, the term of this patent is extended or adjusted under 35 U.S.C. 154(b) by 565 days.

(21) Appl. No.: 13/184,907

(22) Filed: Jul. 18, 2011

(65) Prior Publication Data

US 2012/0171939 A1 Jul. 5, 2012

(30) Foreign Application Priority Data

Dec. 30, 2010 (CN) ..... 2010 1 0616677

(51) Int. Cl.
*B24B 7/04* (2006.01)
*B24B 37/04* (2012.01)
*B24B 57/02* (2006.01)

(52) U.S. Cl.
CPC ..... *B24B 37/04* (2013.01); *B24B 57/02* (2013.01)
USPC ..... 451/66; 451/67; 451/72; 451/280; 451/291; 451/400; 451/446

(58) Field of Classification Search
CPC ..... B24B 5/025; B24B 5/313; B24B 7/228; B24B 27/0076; B24B 27/04; B24B 29/02; B24B 37/04; B24B 37/105; B24B 27/0023; B24B 37/27; B24B 37/345; B24B 53/00; B24B 53/007; B24B 53/017; B24B 57/02
USPC ..... 451/36, 41, 56, 57, 60, 63, 65, 270, 451/280, 283, 285, 287, 288, 289, 291, 292, 451/388, 398, 400, 401, 402, 444, 446, 463, 451/464, 487, 913, 66, 67, 72
See application file for complete search history.

(56) References Cited

U.S. PATENT DOCUMENTS

| | | | | |
|---|---|---|---|---|
| 4,956,944 | A * | 9/1990 | Ando et al. | 451/5 |
| 5,542,874 | A * | 8/1996 | Chikaki | 451/158 |
| 5,931,722 | A * | 8/1999 | Ohmi et al. | 451/271 |
| 6,106,369 | A * | 8/2000 | Konishi et al. | 451/41 |
| 6,379,230 | B1 * | 4/2002 | Hayashi et al. | 451/292 |

(Continued)

FOREIGN PATENT DOCUMENTS

| | | |
|---|---|---|
| CN | 1412831 A | 4/2003 |
| CN | 1471141 A | 1/2004 |

*Primary Examiner* — Timothy V Eley
(74) *Attorney, Agent, or Firm* — Anova Law Group, PLLC

(57) ABSTRACT

A polishing apparatus used in chemical mechanical polishing device is provided. The polishing apparatus includes a polishing plate for holding a wafer to be polished; a polishing pad arm, one end of the polishing pad arm being fixed, another end of the polishing pad arm holding a polishing pad, and the polishing pad arm driving the polishing pad for moving relatively to the wafer; the polishing pad moving relatively to the wafer with drive from the polishing pad arm, and the polishing pad arm ensuring the polishing pad contacting the wafer during movement; and a slurry supply route for supplying polishing slurry between the polishing pad and the wafer during polishing. The present invention also provides a chemical mechanical polishing device. It makes for realizing miniaturization of a chemical mechanical polishing device, saving polishing slurry and improving utilization rate of the polishing pad in the chemical mechanical polishing device to apply the present invention.

12 Claims, 2 Drawing Sheets

(56) References Cited

U.S. PATENT DOCUMENTS

| | | | | |
|---|---|---|---|---|
| 6,555,475 | B1 * | 4/2003 | Pallinti et al. | 438/690 |
| 6,887,133 | B1 * | 5/2005 | Halley | 451/41 |
| 7,238,087 | B1 * | 7/2007 | Kashiwa et al. | 451/41 |
| 7,241,203 | B1 * | 7/2007 | Chen et al. | 451/11 |
| 8,113,918 | B2 * | 2/2012 | Koo et al. | 451/67 |
| 8,382,554 | B2 * | 2/2013 | Kim et al. | 451/8 |
| 2001/0019934 | A1 * | 9/2001 | Nishimura et al. | 451/8 |
| 2002/0132566 | A1 * | 9/2002 | Jeong | 451/57 |
| 2002/0160691 | A1 * | 10/2002 | Ishikawa et al. | 451/8 |
| 2004/0009637 | A1 * | 1/2004 | Ishikawa | 438/200 |
| 2004/0162688 | A1 * | 8/2004 | Eaton et al. | 702/100 |
| 2005/0221736 | A1 * | 10/2005 | Hsin et al. | 451/357 |

* cited by examiner

CHEMICAL MECHANICAL POLISHING DEVICE AND POLISHING ELEMENT

CROSS-REFERENCES TO RELATED APPLICATIONS

The present application claims the priority of Chinese Patent Application No. 201010616677.X, entitled "Chemical mechanical Polishing device and polishing element", and filed on Dec. 30, 2010, the entire disclosure of which is incorporated herein by reference.

BACKGROUND OF THE INVENTION

1. Field of the Invention

The present invention relates to fields of semiconductor technology and, more particularly, relates to a chemical mechanical polishing device and a polishing apparatus.

2. Description of Prior Art

Chemical mechanical polishing (CMP) was introduced into integrate circuit fabrication industry by IBM in 1984, and firstly was applied in planarization of inter metal dielectric (IMD) in back-end process, and then was applied in planarization of tungsten through improvement of device and technique, subsequently was applied in planarization of shallow trench isolation (STI) and cuprum. CMP is an active technique in IC fabrication during recent years.

The mechanism of CMP is that surface material of a polished wafer chemically reacts with polishing slurry to form a correspondingly easily removed surface layer, which can be mechanically polished away with relative movement between the surface layer and a polishing pad through abrasives in the polishing slurry and polishing pressure put on the polished wafer. Specially, when performing CMP on metallic material, the polishing slurry contacts the surface of the metallic material to form metal oxides, and the metal oxides are removed to reach polishing effect.

A CMP device in the prior art is illustrated in FIG. 1. A polishing apparatus of the CMP device includes a polishing plate 102 that automatically rotates and a wafer holder 104. Generally, the polishing plate 102 is designed as a round plate in order to rotate with a polishing pad 106 which is fixed on the polishing plate 102. A wafer 110 that is provided is held by the wafer holder 104 whose position can be adjusted. The wafer holder 104 provides a pressure on the wafer 110 to ensure that the wafer 110 contacts the polishing pad 106 during polishing. A slurry supply route 108 laid upon the polishing plate 102 provides polishing slurry 112 which includes a reactant and an abrasive. The reactant is used for reacting with the surface material of the wafer 110 to form material which can be correspondingly easily polished away. The abrasive is used for mechanical polishing between the polishing pad 106 and the wafer 110. There is usually an adjustor 114 for adjusting the polishing pad 106 in the CMP device.

However, for reducing cost of fabricating a single chip, the size of a wafer is increased, e.g., from 8 inches to 12 inches, or to 18 inches, or even to 24 inches or greater. The increased size of the wafer makes it difficult to uniformly polish the wafer using a CMP technology, especially for polishing the edge of the wafer. In addition, the polishing apparatus of the CMP device may have a large size as the wafer size increases, which may adversely affect miniaturization of the device and may adversely affect maintenance of the CMP device.

SUMMARY OF THE INVENTION

Embodiments of the present invention provides a polishing apparatus used in a chemical mechanical polishing (CMP) device. The polishing apparatus can include a polishing plate having a reduced size to provide the CMP device with reduced sizes.

In one embodiment, a polishing apparatus used in a chemical mechanical polishing device comprises: a polishing plate for holding a wafer that is provided; a polishing pad arm, one end of the polishing pad arm being fixed, another end of the polishing pad arm holding a polishing pad, and the polishing pad arm driving the polishing pad for moving relatively to a wafer; the polishing pad being fixed on the polishing pad arm and moving relatively to the wafer with drive from the polishing pad arm, and the polishing pad arm ensuring the polishing pad contacting the wafer during movement; and a slurry supply route for supplying polishing slurry between the polishing pad and the wafer during polishing.

Optionally, the polishing pad arm holds the polishing pad through a polishing head, which is nipped at an unfixed end of the polishing pad arm.

Optionally, the slurry supply route is formed inside the polishing pad arm.

Optionally, a pressure is put on the wafer by the polishing pad arm, and the pressure is adjusted through changing a height of the polishing pad arm.

Optionally, an angle for the polishing pad arm rotating around a fixed point is less than 360 degree.

Optionally, a shape of the polishing plate is round, and a diameter of the polishing plate is bigger than a diameter of the wafer.

Optionally, a shape of the polishing pad is round or polygon.

Optionally, a diameter of the polishing pad is less than or equal to the diameter of the wafer.

Optionally, the polishing apparatus has one or more polishing plates.

Optionally, the polishing apparatus has a number of polishing pads greater than or equal to a number of the polishing plates.

Optionally, the polishing apparatus further comprises a polishing pad adjusting component, and the polishing pad adjusting component includes a brush for scrubbing the polishing pad and a sprinkler for spraying solutions and/or deionized water.

Optionally, the polishing apparatus further comprises a polishing pad replacing component, and the polishing pad replacing component includes a subcomponent of removing the polishing pad and a subcomponent of installing the polishing pad.

Accordingly, the present invention provides a chemical mechanical polishing device including any one of the above-described polishing apparatus.

Compared with the prior art, the present invention has merits as follows.

First, in the present invention, the polishing plate holds the wafer and the size of the polishing pad is smaller than the size of the wafer, which provides the formed device with reduced sizes even though the wafer having an increased size. This is because the wafer with increased size only requires the polishing plate with increased size, while there is no need to provide the polishing pad with a size greater than the size of the wafer.

Second, in the present invention, the slurry supply route is formed within the polishing pad arm, and thus the polishing slurry can be directly provided on a contact part between the polishing pad and the wafer, thereby saving the polishing slurry and improving utilization rate of the polishing pad during polishing.

Third, in the present invention, during relative movement between the wafer and the polishing pad driven by the polishing pad arm, as the size of the polishing pad is smaller than the wafer, the polishing pad can reach any part of the wafer, which is easy to control polishing uniformity, especially to polish the edge of the wafer without destroying the being polished wafer.

Fourth, an automatic cleaning for the wafer and an automatic replacing for the polishing pad can be implemented through providing the polishing pad adjusting component and the polishing pad replacing component during polishing, thereby improving the polishing efficiency and saving the cost.

DETAILED DESCRIPTION OF THE EMBODIMENTS

Conventional polishing apparatus includes an automatically-rotated polishing plate, a polishing pad fixed on the polishing plate, and a wafer holder to hold a wafer. The wafer has a size smaller than the polishing pad. The wafer has to-be-polished surface facing the polishing pad. A position of the wafer holder can be adjusted. The wafer holder may apply a force to the wafer, which can ensure that the wafer contacts the polishing pad during polishing. A slurry supply route configured above the polishing plate can provide the polishing slurry. The polishing of the wafer may be taken by the polishing pad using the polishing slurry including colloidal silica under relative movement between the polishing pad and the wafer. However, as the size of the wafer increases, the size of the polishing pad and the size of the wafer holder also increase. This may not make devices with small size and may result in waste of material.

Various embodiments provide a polishing apparatus used in a chemical mechanical polishing device. A polishing plate of the polishing apparatus holds a wafer to be polished. The wafer has a surface facing upwards (i.e., the surface to be polished is opposite to the polishing plate). A polishing pad arm of the polishing apparatus fixes a polishing pad thereon, and has the polishing pad rotating relative to the wafer, such that the polishing pad contacts the surface of the wafer to be polished during the rotating to implement the polishing of the wafer.

Hereunder, the present invention will be described in detail with reference to embodiments, in conjunction with the accompanying drawings.

For fully understanding the present invention, the invention is detailed in the embodiment as below. However, as the invention can be implemented in other embodiments that are deferent, those skilled in the art can generalize the invention without departing from the spirit and scope of the present invention. Therefore, the invention should not be limited to the embodiments disclosed here.

Figure 1:
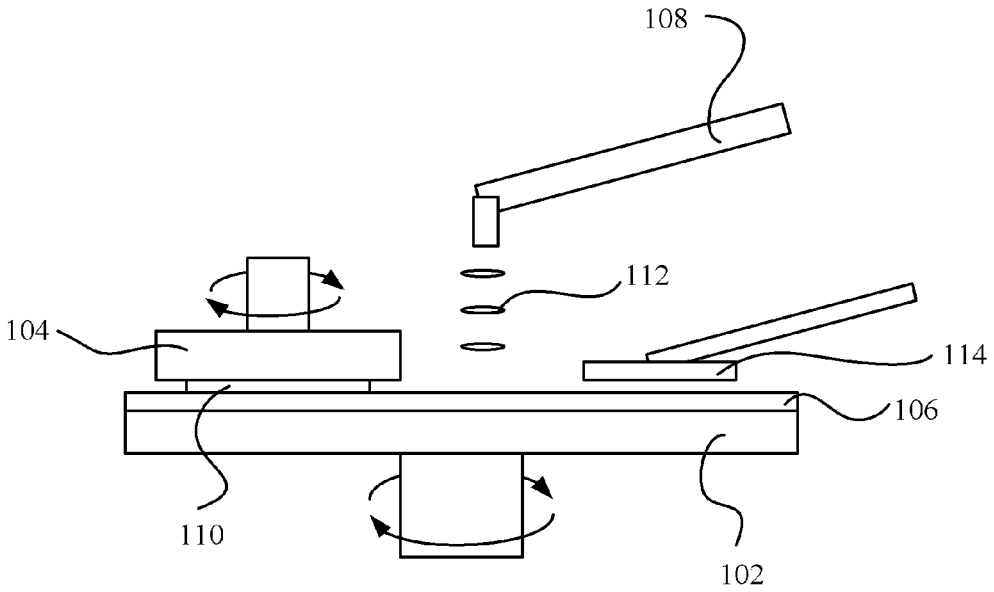
FIG1 (prior art)
FIG. 1 schematically illustrates a polishing apparatus used in a chemical mechanical polishing device in the prior art.
Figure 2:
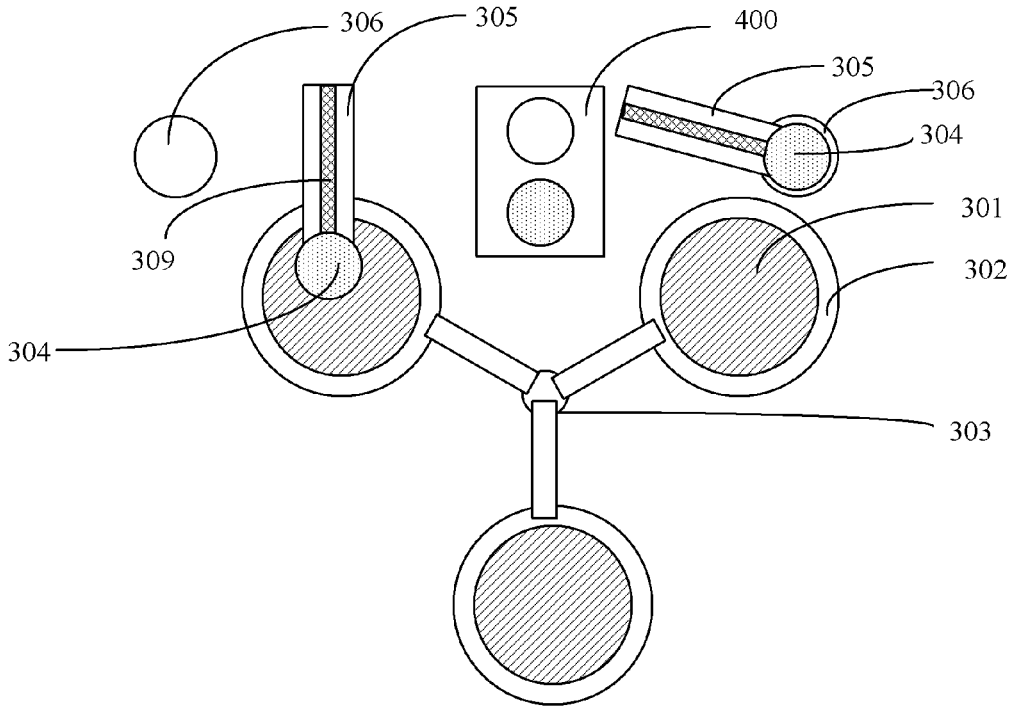
FIG. 2 schematically illustrates a polishing apparatus in present invention.

FIG. 2 schematically illustrates a polishing apparatus used in a chemical mechanical polishing device in present invention. The polishing apparatus comprises:

a polishing plate 302 for holding a wafer 301 that is provided;

a polishing pad arm 305, one end of the polishing pad arm 305 being fixed, another end of the polishing pad arm 305 holding a polishing pad 304, and the polishing pad arm 305 driving the polishing pad 304 for moving relatively to a wafer 301;

the polishing pad 304 being fixed on the polishing pad arm 305 and moving relatively to the wafer 301 with drive from the polishing pad arm 305, and the polishing pad arm 305 ensuring the polishing pad 304 contacting the wafer 301 during movement; and a slurry supply route 309 for supplying polishing slurry between the polishing pad 304 and the wafer 301 during polishing (not shown).

An exemplary polishing apparatus used in a chemical mechanical polishing device has three polishing heads. Each polishing head has one polishing pad in some embodiments. In other embodiments, the number of the polishing pad can be other than three and may be more or less than 3, such as 1, 2, or 5 . . . .

In an embodiment, in order to save space, a shape of the polishing plate 302 can be designed as round, and a diameter of the polishing plate 302 is bigger than a diameter of the wafer 301. The advantage for the diameter of the polishing plate 302 being bigger than the diameter of the wafer 301 is that the wafer 301 to be polished can be fully laid on the polishing plate 302 and absorbed on the polishing plate 302, such as by vacuum absorb, whereby the polishing plate 302 can provide symmetrical supporting power to the wafer 301 during polishing, which avoids wafer being destroyed from asymmetrical pressure when the polishing pad 304 rotates on the surface of the wafer 301.

In the embodiment, the three polishing plates 302 are connected together using a rotating shaft 303. The three polishing plates 302 can work at a same time, or at a different time. For example, when one polishing plate is in operation, the other two may be idle. Correspondingly, the three polishing plates 302 can rotate synchronously, or asynchronously. Further, the three polishing plates 302 rotate in part and stop partly. Each polishing plate 302 is controlled by a different motor that can be independently programmed, so users can program according to specific needs.

The polishing pad arm 305 can have one end fixed, and can move relatively to the provided wafer. For example, the polishing pad arm 305 and the wafer can move in different direction or rotate around a fixed point. In a preferred embodiment of the present invention, a rotating angle of the polishing pad arm 305 is less than 360 degree for saving a space occupied during rotating. The other end of the polishing pad arm 305 holds the polishing pad 304, for example, through the polishing head that is attached on the unfixed end of the polishing pad arm 305. For example, the polishing pad 304 is absorbed on a surface of the polishing head by vacuum absorption, or adhered to the surface of the polishing head by suitable glue. The slurry supply route 309 is arranged corresponding to the polishing pad arm 305, for example, configured inside the polishing pad arm 305 or outside the polishing pad arm 305. The slurry supply route 309 supplies slurries between the polishing pad 304 and the wafer to be polished during polishing (not shown).

The polishing head is used to hold the polishing pad 304.

The polishing pad 304 moves relatively to the provided wafer 301 with drive from polishing pad arm 305 and the polishing head, and it can be ensured that the polishing pad 304 contacts the provided wafer 301 during movement through adjusting a height of the polishing pad arm 305.

Further, the polishing pad arm 305 can apply a force (or a pressure) on the wafer 301. Such force can be adjusted by adjusting a height of the polishing pad arm 305. Referring to FIG. 2, when the position of the polishing pad arm 305 is relatively lower than the polishing plate 302, that is, the elastic deformation of the polishing plate 302 caused by the polishing pad arm becomes bigger, the force (or pressure) put on the wafer 301 by the polishing pad arm can be bigger. Contacting surface between the polishing pad 304 and the wafer 301 can receive the polishing slurry provided by the slurry supply route 309. Components of the polishing slurry are relevant to the polishing object. Taking metal polishing for example, the polishing slurry oxidizes a metal surface of the wafer 301 to form a metal oxide. The polishing pad arm 305 controls the polishing pad 304 to put a downward pressure on the wafer 301, and drives the polishing pad 304 to move relatively to the wafer 301. Track of movement is controllable, and a specific controlling manner can be implemented by programming a driving apparatus (not shown) of the polishing pad arm 305. The metal oxide on the wafer can be removed by the pressure and the movement relative to polishing pad. In addition, the wafer 301 can rotates by itself for improving polishing uniformity. The polishing pad 304 is fixed on the unfixed end of the polishing pad arm 305, and can rotate with the polishing pad arm 305, which ensures that the polishing pad 304 contacts the provided wafer during polishing.

In the present embodiment, the number of the polishing pad 304 is equal to the number of the polishing plate 302. In other embodiment of the present invention, the number of the polishing pad 304 can also be bigger than the number of the polishing plate 302. Some polishing pads 304 rotate relatively to the wafer for accelerating polishing speed during polishing. However, in this instance, it is necessary to strictly control the rotating track of each polishing pad 304 for avoiding collision of the polishing pad 304 between each other.

In the present embodiment, because the size of the polishing pad 304 is smaller than the size of the polishing plate 302, the polishing pad 304 can be controlled to rotate on any surface portions of the polishing plate 302 (e.g., on an edge of the wafer) to perform a uniform polishing.

In addition, the slurry supply route 309 is integrated with polishing pad arm 305, and supplies polishing slurry on the contacting part between the polishing pad 304 and the wafer 301 through the polishing pad 304. The polishing slurry uniformly covers the surface of the wafer 301 during the polishing pad 304 rotating relatively to the wafer 301, in result of reducing waste of the polishing slurry and improving utilization rate of the polishing slurry.

In the preferred embodiment of the present invention, the polishing apparatus used in chemical mechanical polishing device further comprises a polishing pad adjusting component 306 that is used to clean the polishing pad 304.

In the present embodiment, the polishing pad arm 305 may also control the polishing pad 304 to enter the polishing pad adjusting component 306 for realizing automatic cleaning the polishing pad 304.

In a conventional chemical mechanical polishing device, a manual cleaning is applied for cleaning the polishing pad 304, e.g., facilitated by engineers at regular intervals. But in the present embodiment, cleaning the polishing pad 304 is controlled by software. In working status, the polishing pad arm 305 rotates at an angle to position the polishing pad 304 in the polishing pad adjusting component 306 at regular intervals (the regular intervals can be set by software). The function of the polishing pad adjusting component 306 is to take away some byproducts produced during polishing. The polishing pad adjusting component 306 includes a brush for scrubbing the polishing pad and a sprinkler for spraying solutions and/or deionized water. Some hard granules adhere to a surface of the brush. The hard granules can scrub the polishing pad to partly scrub away the byproducts from the surface of the polishing pad 304. The sprinkler can spray solutions and/or deionized water to clean the polishing pad.

In a preferred embodiment of the present invention, the polishing apparatus further includes a polishing pad replacing component 400 that is used to replace the polishing pad 304.

The polishing pad replacing component 400 includes a subcomponent of removing the polishing pad and a subcomponent of installing the polishing pad.

In working status, the polishing pad arm 305 rotates an angle for laying the polishing pad 304 in the subcomponent of removing the polishing pad of the polishing pad replacing component 400 at regular intervals (the regular intervals can be set by software). The polishing pad 304 is removed from the subcomponent of removing the polishing pad, for example, through dissolving a glue between the polishing pad 304 and polishing head by solutions to remove the polishing pad 304, and then the polishing pad arm 305 rotates an angle for laying the polishing pad 304 in the subcomponent of installing the polishing pad of the polishing to install the polishing pad 304.

The present invention further provides a chemical mechanical polishing device that includes any one of the items accorded to the polishing apparatus used in the chemical mechanical polishing device.

Figure 3:
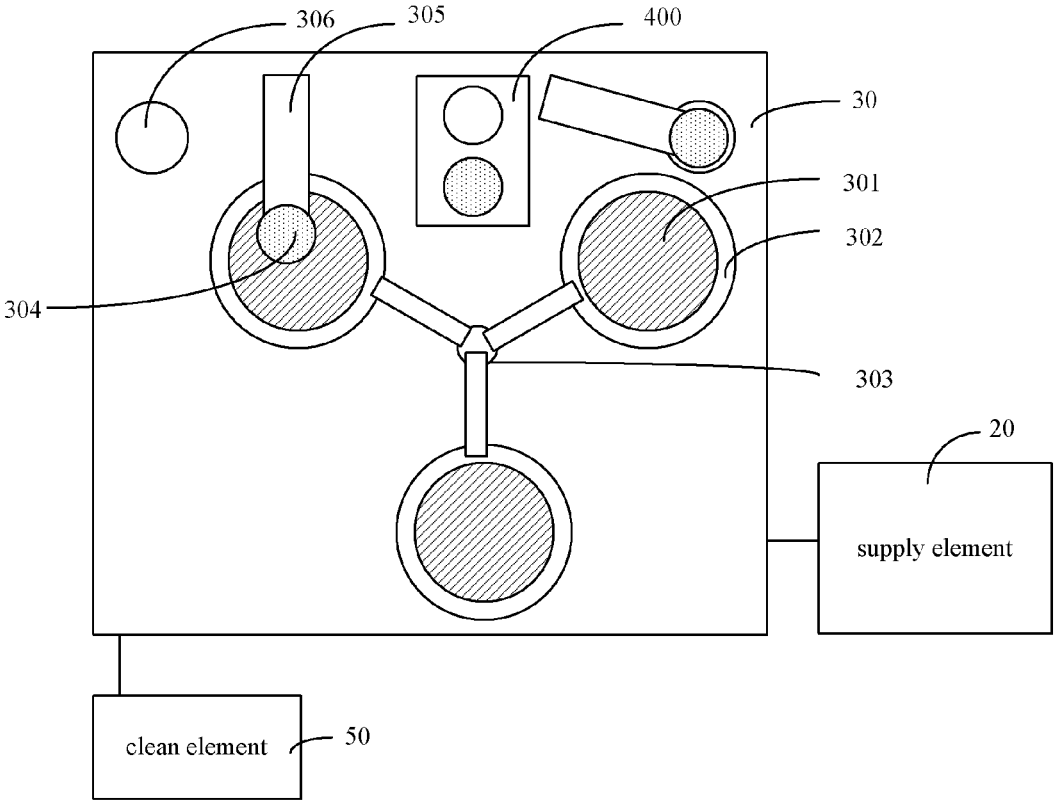
FIG. 3 schematically illustrates a chemical mechanical polishing device including a polishing apparatus in present invention.

Referring to FIG. 3, the present invention provides the chemical mechanical polishing device provided further including a supply apparatus 20 for supplying wafers and a clean apparatus 50 for cleaning polished wafers.

The supply apparatus 20 delivers a wafer 301 to be polished to the polishing apparatus 30, and places the wafer on a polishing plate 302. A polishing pad arm 305 and a polishing head may have the polishing pad 304 rotating relatively to the wafer 301. In addition, the wafer 301 can rotates with the polishing plate 302 synchronously or asynchronously. While the polishing pad 304 moving relatively to the wafer 301, the slurry supply route 309 supplies polishing slurries between the polishing pad 304 and the wafer 301 to polish.

Meanwhile, a polishing pad adjusting component 306 is used to clean the polishing pad 304.

A polishing pad replacing component 400 is used to replace the polishing pad 304.

Compared with the prior art, the present invention has merits as follows:

First, in the present invention, the polishing plate holds the wafer and the size of the polishing pad is smaller than the size of the wafer, which provides the formed device with reduced sizes even though the wafer having an increased size. This is because the wafer with increased size only requires the polishing plate with increased size, while there is no need to provide the polishing pad with a size greater than the size of the wafer.

Second, in the present invention, the slurry supply route is formed in the polishing pad arm, and thus the polishing slurry can be directly provided on a contact part between the polishing pad and the wafer, thereby saving the polishing slurry and improving utilization rate of the polishing pad during polishing.

Third, in the present invention, during relative movement between the wafer and the polishing pad driven by the polishing pad arm, as the size of the polishing pad is smaller than the wafer, the polishing pad can reach any part of the wafer, which is easy to control polishing uniformity, especially to polish the edge of the wafer without destroying the being polished wafer.

Fourth, an automatic cleaning for the wafer and an automatic replacing for the polishing pad can be implemented through providing the polishing pad adjusting component and the polishing pad replacing component during polishing, thereby improving the polishing efficiency and saving the cost.

Although the present invention has been disclosed as above with reference to preferred embodiments thereof but will not be limited thereto. Those skilled in the art can modify and vary the embodiments without departing from the spirit and scope of the present invention. Accordingly, the scope of the present invention shall be defined in the appended claims.

What is claimed is:

1. A polishing apparatus used in a chemical mechanical polishing device, comprising:

a plurality of polishing plates for holding a wafer to be polished;

a plurality of polishing pad arms each having one end being fixed, and having another end holding a polishing pad, and configured such that the polishing pad arm moves the polishing pad relatively to the wafer, and the polishing pad arm ensuring the polishing pad contacting the wafer during movement;

a slurry supply route for supplying polishing slurry between the polishing pad and the wafer during polishing; and a polishing pad replacing component positioned between adjacent polishing plates of the plurality of polishing plates, and also between adjacent polishing pad arms of the plurality of polishing pad arms.

2. The polishing apparatus according to claim 1, wherein the each polishing pad arm holds the polishing pad through a polishing head attached at an unfixed end of the polishing pad arm.

3. The polishing apparatus according to claim 1, wherein the slurry supply route is formed inside the polishing pad arm.

4. The polishing apparatus according to claim 1, wherein a pressure is put on the wafer by the polishing pad arm, and the pressure is adjusted by changing a height of the polishing pad arm.

5. The polishing apparatus according to claim 1, wherein an angle for the polishing pad arm rotating around the one end being fixed is less than 360 degree.

6. The polishing apparatus according to claim 1, wherein a shape of the polishing plate is round, and a diameter of the polishing plate is greater than a diameter of the wafer.

7. The polishing apparatus according to claim 6, wherein a diameter of the polishing pad is less than or equal to the diameter of the wafer.

8. The polishing apparatus according to claim 1, wherein a shape of the polishing pad is round or polygon.

9. The polishing apparatus according to claim 1, wherein a number of the polishing pads is greater than or equal to a number of the polishing plates.

10. The polishing apparatus according to claim 1, further comprising a polishing pad adjusting component, wherein the polishing pad adjusting component includes a brush for scrubbing the polishing pad and a sprinkler for spraying solutions and/or deionized water.

11. The polishing apparatus according to claim 1, wherein the polishing pad replacing component includes a subcomponent for removing the polishing pad and a subcomponent for installing the polishing pad.

12. A chemical mechanical polishing device, comprising the polishing apparatus according to claim 1.

* * * * *